US009841019B2

(12) United States Patent
Sakai et al.

(10) Patent No.: US 9,841,019 B2
(45) Date of Patent: Dec. 12, 2017

(54) FUEL PUMP WITH A JOINT MEMBER HAVING A LEG INSERTED INTO AN INSERTION HOLE OF AN INNER GEAR

(71) Applicant: DENSO CORPORATION, Kariya, Aichi-pref. (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 30 days.

(21) Appl. No.: 15/096,665

(22) Filed: Apr. 12, 2016

(65) Prior Publication Data

US 2016/0305426 A1 Oct. 20, 2016

(30) Foreign Application Priority Data

Apr. 14, 2015 (JP) ..... 2015-82665

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/10*** | (2006.01) |
| ***F04C 2/08*** | (2006.01) |
| ***F04C 15/00*** | (2006.01) |
| ***F02M 59/12*** | (2006.01) |

(52) U.S. Cl.

CPC ..... *F04C 2/102* (2013.01); *F02M 59/12* (2013.01); *F04C 2/084* (2013.01); *F04C 15/008* (2013.01); *F04C 15/0061* (2013.01); *F04C 2210/1044* (2013.01); *F04C 2240/30* (2013.01)

(58) Field of Classification Search

CPC ..... F04C 2/102; F04C 2/084; F04C 15/0061; F04C 15/008; F04C 2210/1044; F04C 2240/20; F04C 2240/30; F04C 2240/50; F04C 2240/56; F02M 59/12

USPC ..... 418/166, 171

See application file for complete search history.

(56) References Cited

U.S. PATENT DOCUMENTS 4,500,270 A * 2/1985 Tuckey ..... F04C 2/102 418/171
4,629,399 A * 12/1986 Friebe ..... F04C 2/102 418/171

(Continued)

FOREIGN PATENT DOCUMENTS

JP 05195961 A * 8/1993 ..... F04C 2/102
JP 6-123288 5/1994

*Primary Examiner* — Theresa Trieu
(74) *Attorney, Agent, or Firm* — Nixon & Vanderhye P.C.

(57) ABSTRACT

An inner gear includes an insertion hole, which extends through the inner gear in an axial direction, and a first balance groove, which is axially recessed at an axial end portion of the inner gear and is communicated with the insertion hole. First and second chamfered portions are formed in an inner peripheral edge of the inner gear, which is adjacent to the insertion hole. A joint member has a leg inserted into the insertion hole. An inserting direction of the leg into the insertion hole is defined as a first direction, and a direction, which is opposite from the first direction, is defined as a second direction. In a view taken in a direction perpendicular to the axial direction, at least a part of a first direction side end portion of the leg is axially placed between a first chamfered end plane and a first groove end plane.

7 Claims, 13 Drawing Sheets

(56) References Cited

U.S. PATENT DOCUMENTS

| | | | | | |
|---|---|---|---|---|---|
| 4,820,138 | A | * | 4/1989 | Bollinger | F04C 2/102 418/171 |
| 4,969,806 | A | * | 11/1990 | Nusser | F04C 2/102 418/171 |
| 5,145,348 | A | * | 9/1992 | Zumbusch | F04C 2/102 418/171 |
| 5,263,818 | A | * | 11/1993 | Ito | F04C 2/102 418/171 |
| 5,340,293 | A | | 8/1994 | Yasuda et al. | |
| 6,082,984 | A | * | 7/2000 | Matsumoto | F04C 2/102 418/171 |
| 2008/0112821 | A1 | | 5/2008 | Morris | |

* cited by examiner

FUEL PUMP WITH A JOINT MEMBER HAVING A LEG INSERTED INTO AN INSERTION HOLE OF AN INNER GEAR

CROSS REFERENCE TO RELATED APPLICATION

This application is based on and incorporates herein by reference Japanese Patent Application No. 2015-82665 filed on Apr. 14, 2015.

TECHNICAL FIELD

The present disclosure relates to a fuel pump that includes pump chambers, which sequentially draw fuel and discharge the fuel after compression of the fuel therein.

BACKGROUND

There is known a fuel pump that includes pump chambers, which sequentially draw fuel and discharge the fuel after compression of the fuel therein. For example, a fuel pump disclosed in JPH06-123288A has an outer gear, an inner gear, a pump housing and an electric motor. The outer gear includes internal teeth. The inner gear includes external teeth and is eccentric to, i.e., is decentered from the outer gear in an eccentric direction. The pump housing rotatably receives the outer gear and the inner gear. The electric motor has a rotatable shaft that is driven to rotate upon energization of the electric motor. Pump chambers are formed between the outer gear and the inner gear. When the outer gear and the inner gear are rotated, a volume of the respective pump chambers is increased and decreased to draw and discharge fuel. A joint member couples between the rotatable shaft and the inner gear. That is, a drive force of the rotatable shaft is transmitted to the inner gear through the joint member.

The joint member and the inner gear discussed above may possibly be configured in a manner shown in FIG. 19. Specifically, FIG. 19 is an enlarged cross sectional view indicating a joint member 160 and an inner gear 120 of a first comparative example. In the drawing, an upward direction along a rotational axis of the inner gear 120 will be also referred to as a first direction, and a downward direction along the rotational axis will be also referred to as a second direction. Furthermore, an upper side of the drawing will be also referred to as a first direction side, and a lower side of the drawing will be also referred to as a second direction side. The inner gear 120 is rotatable in both of a rotational direction Rig and a counter-rotational direction, which are opposite to each other. Legs 164 of the joint member 160 are inserted into insertion holes 127, respectively, of the inner gear 120 in the first direction to transmit the drive force of the rotatable shaft to the inner gear 120 through the joint member 160. FIG. 19 indicates one of the legs 164 of the joint member 160 inserted into the corresponding one of the insertion holes 127 of the inner gear 120. In FIG. 19, a first balance groove 121, which is filled with fuel, is formed in an upper end portion (also referred to as a first direction side end portion) of the inner gear 120, and a second balance groove 153, which is filled with fuel, is formed in a lower end portion (also referred to as a second direction side end portion) of the inner gear 120. A fuel pressure, which is exerted downward in the axial direction by the fuel filled in the first balance groove 121, is balanced with a fuel pressure, which is exerted upward in the axial direction by the fuel filled in the second balance groove 153 to stabilize the orientation of the inner gear 120. Thereby, the inner gear 120 can be rotated in a stable manner.

Inventors of the present application have found that the stable rotation of the inner gear 120 becomes difficult in a case where a relatively large gap space A is present between an upper end surface (also referred to as a first direction side end surface) 161*a* of the leg 164 of the joint member 160 and a bottom surface (see an imaginary plane 123 of FIG. 19, which is formed by extending of the bottom surface) of the first balance groove 121 of FIG. 19 in the axial direction. Specifically, when the joint member 160 is moved repeatedly by the drive force transmitted from the rotatable shaft in the state where the fuel is filled in the gap space A, a fuel pressure in the gap space A is changed by the movement of the joint member 160. Thereby, the pressure, which is exerted against the inner gear 120 in the upward direction, and the pressure, which is exerted against the inner gear 120 in the downward direction, are unbalanced. Thus, the inner gear 120 is rotated in an unstable manner.

Furthermore, the inventors of the present application have also found the following disadvantage. Specifically, with reference to FIG. 20, which indicates a second comparative example, when an upper end portion (also referred to as a first direction side end portion) 161 of the leg 164 is placed on the first direction side of an upper end (also referred to as a first direction side end) of the first balance groove 121, the leg 164 largely projects from the insertion hole 127 in the first direction. Therefore, the projected portion of the leg 164 may possible contact another member. In such a case, an unnecessary force is applied to the joint member 160, and thereby, the transmission of the drive force from the joint member 160 to the inner gear 120 in the stable manner may become difficult, thereby interfering the stable rotation of the inner gear 120.

SUMMARY

The present disclosure is made in view of the above disadvantages. According to the present disclosure, there is provided a fuel pump including an outer gear, an inner gear, a pump housing, a motor and a joint member. The outer gear has a plurality of internal teeth. The inner gear has a plurality of external teeth. The inner gear is eccentric to the outer gear in an eccentric direction and is meshed with the outer gear in the eccentric direction. The pump housing rotatably receives the outer gear and the inner gear. The motor includes a rotatable shaft, which is driven to rotate upon energization of the motor. The joint member relays the rotatable shaft to the inner gear to rotate the inner gear in a circumferential direction. The inner gear includes a gear main body, a through-hole, two recessed grooves and a chamfered portion. The through-hole extends through the gear main body in an axial direction of the rotatable shaft. The two recessed grooves are formed at two end portions, respectively, of the gear main body, which are opposite to each other in the axial direction, such that the two recessed grooves are recessed in the axial direction and are continuous with the through-hole. The chamfered portion is formed in a peripheral edge of the gear main body, which is adjacent to the through-hole. The joint member includes a joint main body and a leg. The joint main body is fitted to the rotatable shaft. The leg extends from the joint main body in the axial direction and is inserted into the through-hole. An inserting direction of the leg into the through-hole in the axial direction is defined as a first direction, and a direction, which is opposite from the first direction in the axial direction, is defined as a second direction. In a view taken in a direction that is perpendicular to the axial direction, at least a part of a first direction side end portion of the leg is axially placed between: a second direction side end of the chamfered portion, which is formed at the first direction side; and a first direction side end of a corresponding one of the two recessed grooves, which is formed at the first direction side.

BRIEF DESCRIPTION OF THE DRAWINGS

The drawings described herein are for illustration purposes only and are not intended to limit the scope of the present disclosure in any way.

DETAILED DESCRIPTION

First Embodiment

A first embodiment of the present disclosure will be described with reference to the accompanying drawings.

Figure 1:
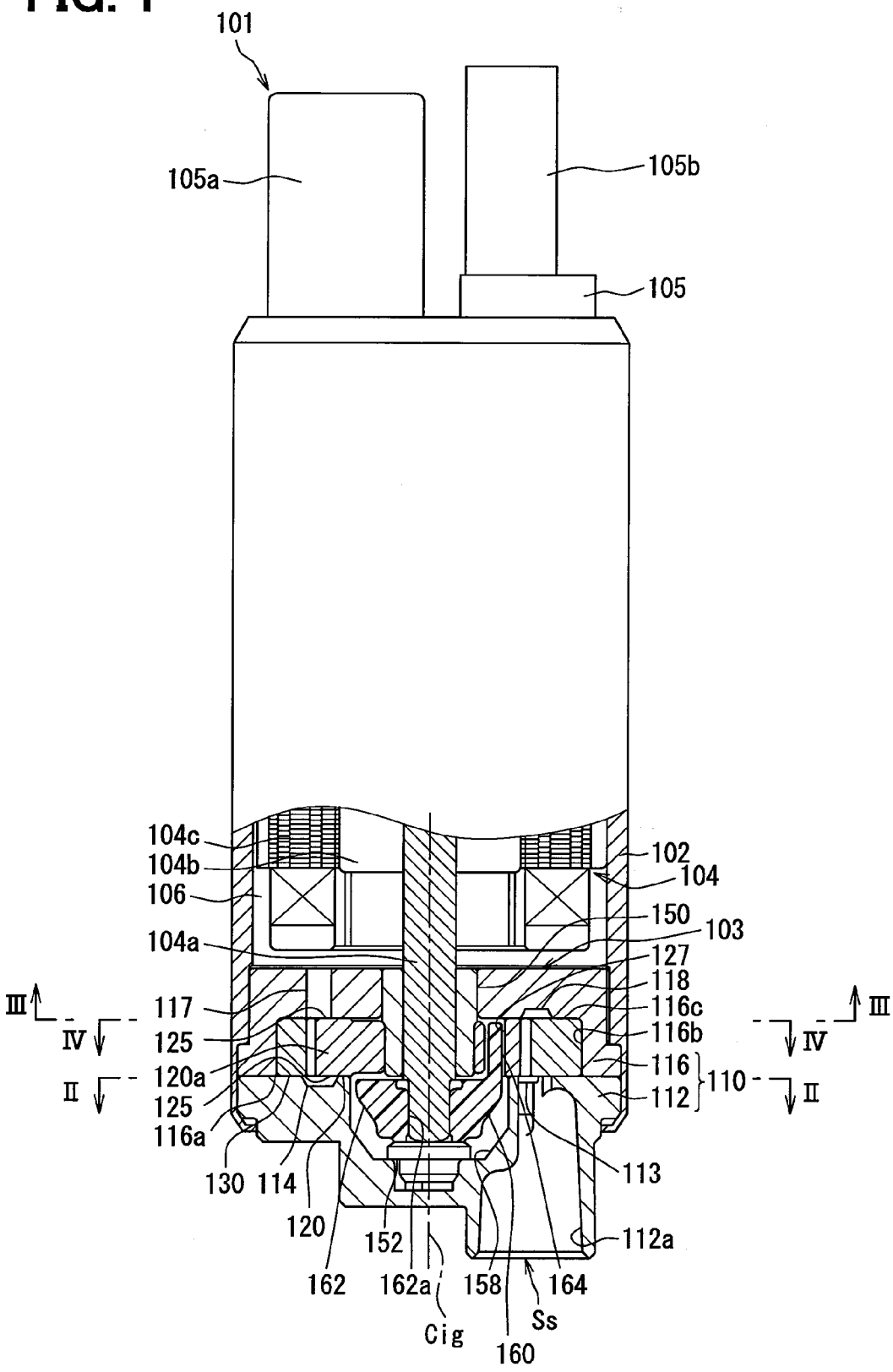
FIG. 1 is a partial cross-sectional view indicating a fuel pump according to a first embodiment of the present disclosure.

As shown in FIG. 1, a fuel pump 101 according to a first embodiment of the present disclosure is a gerotor pump that is also known as a Trochoid (registered trademark) pump. The fuel pump 101 includes a pump main body 103 and an electric motor 104, which are received in an inside of a pump body 102 that is configured into a cylindrical tubular form. Furthermore, the fuel pump 101 includes a side cover 105. The side cover 105 projects from an end of the pump body 102, which is located on a side of the electric motor 104 that is opposite from the pump main body 103 in the axial direction. The side cover 105 includes an electric connector 105*a*, which supplies an electric power to the electric motor 104, and a discharge port 105*b*, through which fuel is discharged from the fuel pump 101. In the fuel pump 101, a rotatable shaft 104*a* of the electric motor 104 is rotated when the electric power is supplied from an external circuit through the electric connector 105*a* to energize the electric motor 104. Thus, an outer gear 130 and an inner gear 120 of the pump main body 103 are rotated by a drive force of the rotatable shaft 104*a* of the electric motor 104, and thereby fuel is drawn into and compressed in the fuel pump 101 and is then discharged from the fuel pump 101 through the discharge port 105*b*. The fuel pump 101 pumps light oil (diesel fuel), which has the higher viscosity in comparison to gasoline, as the fuel.

In the present embodiment, the electric motor 104 is an inner gear brushless motor and includes magnets 104*b*, which form four magnetic poles, and coils 104*c*, which are installed in six slots. For example, at a time of turning on of an ignition switch of the vehicle or a time of depressing an accelerator pedal, a positioning control operation of the electric motor 104 is executed to rotate the rotatable shaft 104*a* toward a drive rotation side or a counter-drive rotation side (the counter-drive rotation side being opposite from the drive rotation side). Thereafter, the electric motor 104 executes a drive control operation, which rotates the rotatable shaft 104*a* from the position, at which the rotatable shaft 104*a* is positioned in the positioning control operation, toward the drive rotation side. In the present embodiment, the electric motor 104 serves as a motor of the present disclosure.

Here, the drive rotation side is a positive direction side of a rotational direction Rig of the inner gear 120 in a circumferential direction of the inner gear 120. The counter-drive rotation side is a negative direction side of the rotational direction Rig of the inner gear 120, which is opposite from the positive direction side.

Hereinafter, the pump main body 103 will be described in detail. The pump main body 103 includes a pump housing 110, the inner gear 120, the outer gear 130 and a joint member 160. The pump housing 110 includes a pump cover 112 and a pump casing 116, which are placed one after another in the axial direction.

The pump cover 112 is made of metal and is shaped into a circular disk form. The pump cover 112 axially projects outward from the end part of the pump body 102, which is located on the side of the electric motor 104 that is opposite from the side cover 105.

Figure 2:
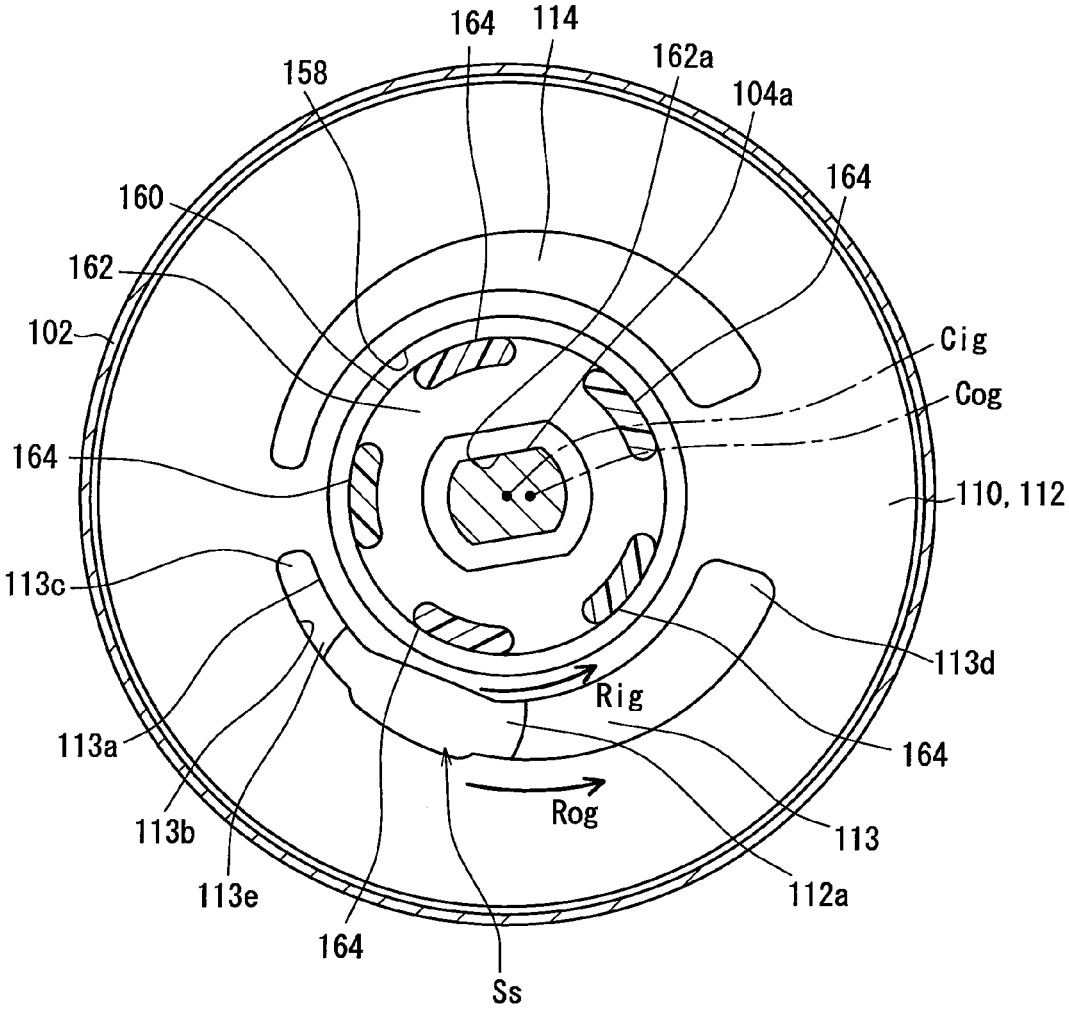
FIG. 2 is a cross-sectional view taken along line II-II in FIG. 1.

In order to draw the fuel from an outside of the fuel pump 101, the pump cover 112 shown in FIGS. 1 and 2 has a suction inlet 112*a*, which is formed as a cylindrical hole, and a suction passage 113, which is shaped into an arcuate form. In the pump cover 112, the suction inlet 112*a* extends through a predetermined opening location Ss, which is eccentric from a central axis (hereinafter referred to as an inner central axis) Cig of the inner gear 120, in the axial direction. The suction passage 113 opens on the pump casing 116 side of the pump cover 112. As shown in FIG. 2, an inner peripheral portion 113*a* of the suction passage 113 has a circumferential extent, which is less than one half (less than 180 degrees) of an entire circumference of the inner gear 120 in the rotational direction Rig (also see FIG. 4). An outer peripheral portion 113*b* of the suction passage 113 has a circumferential extent, which is less than one half (less than 180 degrees) of an entire circumference of the outer gear 130 in the rotational direction Rog (also see FIG. 4).

The suction passage 113 extends from a start end part 113*c* to a terminal end part 113*d* in the rotational direction Rig, Rog such that a radial extent (hereinafter referred to as a width) of the suction passage 113, which is measured in a radial direction of the rotational axis, progressively increases in the rotational direction Rig, Rog from the start end part 113*c* to the terminal end part 113*d*. The suction inlet 112*a* opens in a groove bottom portion 113*e* of the suction passage 113 at the opening area Ss, so that the suction passage 113 is communicated with the suction inlet 112*a*. As shown particularly in FIG. 2, in an entire range of the opening area Ss, in which the suction inlet 112*a* opens, the width of the suction passage 113 is smaller than a width (diameter) of the suction inlet 112*a*.

Furthermore, the pump cover 112 forms an installation space 158 at an area that is opposed to the inner gear 120 along the inner central axis Gig. The installation space 158 is shaped into a recessed hole. A main body 162 of the joint member 160 is rotatably installed in the installation space 158.

Figure 3:
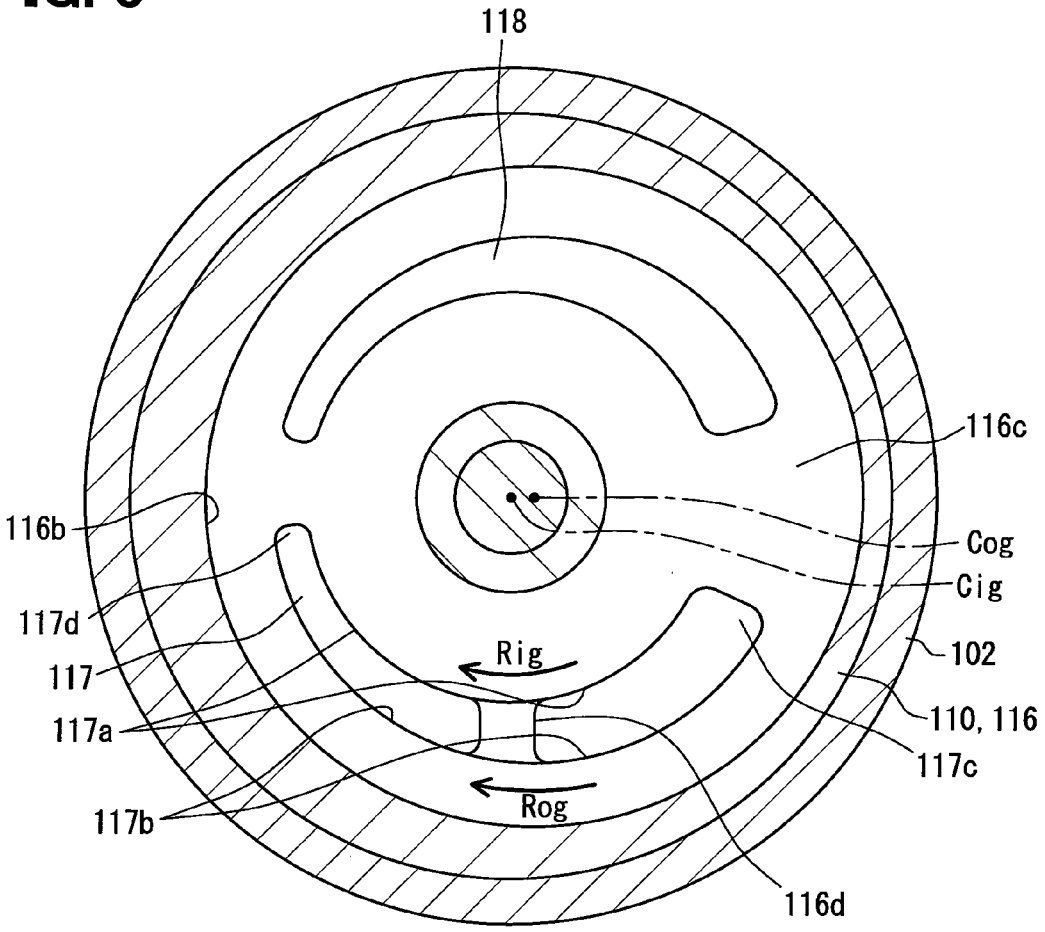
FIG. 3 is a cross-sectional view taken along line III-III in FIG. 1.
Figure 4:
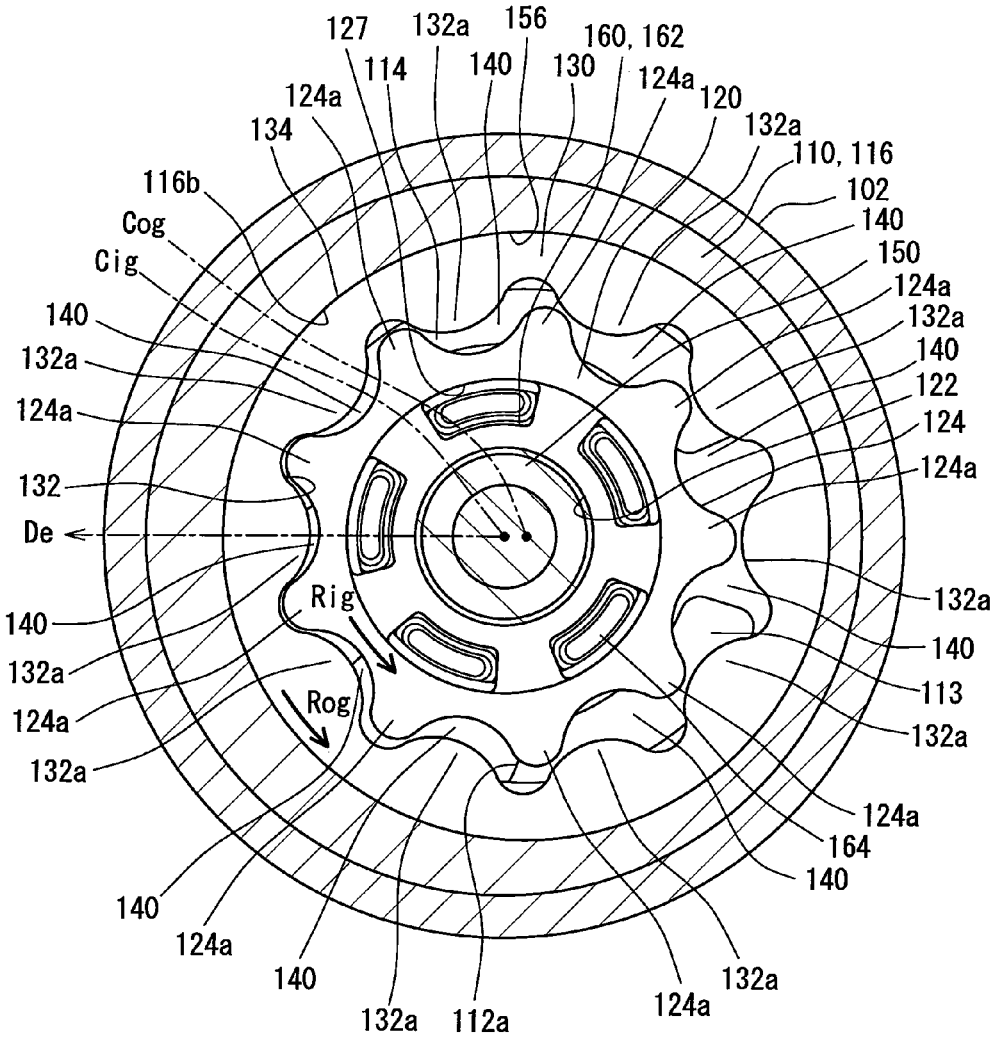
FIG. 4 is a cross-sectional view taken along line IV-IV in FIG. 1.

The pump casing 116 shown in FIGS. 1, 3 and 4 is made of metal and is shaped into a cylindrical tubular form having a bottom. An opening portion 116*a* of the pump casing 116 is covered with the pump cover 112 such that an entire circumferential extent of the opening portion 116*a* is tightly closed by the pump cover 112. As shown particularly in FIGS. 1 and 4, an inner peripheral portion 116*b* of the pump casing 116 is formed as a cylindrical hole that is eccentric relative to the inner central axis Cig of the inner gear 120.

The pump casing 116 forms a discharge passage 117, which is formed as an arcuate hole, to discharge the fuel from the discharge port 105*b* through a fuel passage 106 defined between the pump body 102 and the electric motor 104. The discharge passage 117 axially extends through a recessed bottom portion 116*c* of the pump casing 116. Particularly, as shown in FIG. 3, an inner peripheral portion 117*a* of the discharge passage 117 has a circumferential extent, which is less than one half (i.e., less than 180 degrees) of the entire circumference of the inner gear 120 in the rotational direction Rig. An outer peripheral portion 117*b* of the discharge passage 117 has a circumferential extent, which is less than one half (less than 180 degrees) of the entire circumference of the outer gear 130 in the rotational direction Rog. A radial extent (hereinafter referred to as a width) of the discharge passage 117, which is measured in the radial direction, progressively decreases in the rotational direction Rig, Rog from a start end part 117*c* to a terminal end part 117*d*.

Furthermore, the pump casing 116 includes a reinforcing rib 116*d* in the discharge passage 117. The reinforcing rib 116*d* is formed integrally with the pump casing 116 such that the reinforcing rib 116*d* extends across the discharge passage 117 in a crossing direction, which crosses the rotational direction Rig of the inner gear 120, and thereby the reinforcing rib 116*d* reinforces the pump casing 116.

A suction groove 118 shown particularly in FIG. 3 is formed in the recessed bottom portion 116*c* of the pump casing 116 at a corresponding area that is opposed to the suction passage 113 in the axial direction while pump chambers 140 (described later in detail) are interposed between the suction groove 118 and the suction passage 113 in the axial direction. The suction groove 118 is an arcuate groove that corresponds to a shape, which is produced by projecting the suction passage 113 onto the pump casing 116 in the axial direction. In this way, in the pump casing 116, the discharge passage 117 is formed to be symmetric to the suction groove 118 with respect to the symmetry axis located between the discharge passage 117 and the suction groove 118. As shown particularly in FIG. 2, a discharge groove 114 is formed in the pump cover 112 at a corresponding area that is opposed to the discharge passage 117 in the axial direction while the pump chambers 140 are interposed between the discharge groove 114 and the discharge passage 117 in the axial direction. The discharge groove 114 is formed as an arcuate groove that is shaped to correspond with a shape, which is produced by projecting the discharge passage 117 onto the pump cover 112 in the axial direction. In this way, in the pump cover 112, the suction passage 113 is formed to be symmetric to the discharge groove 114 with respect to the symmetry axis located between the suction passage 113 and the discharge groove 114.

As shown in FIG. 1, a radial bearing 150 is securely fitted to the recessed bottom portion 116*c* of the pump casing 116 along the inner central axis Cig to radially support the rotatable shaft 104*a* of the electric motor 104 in a manner that enables rotation of the rotatable shaft 104*a*. Furthermore, a thrust bearing 152 is securely fitted to the pump cover 112 along the inner central axis Cig to axially support the rotatable shaft 104*a* in a manner that enables the rotation of the rotatable shaft 104*a*.

As shown in FIGS. 1 and 4, a receiving space 156, which receives the inner gear 120 and the outer gear 130, is formed by the recessed bottom portion 116*c* and the inner peripheral portion 116*b* of the pump casing 116 in cooperation with the pump cover 112. The inner gear 120 and the outer gear 130 are trochoid gears, which have a trochoid tooth profile.

Figure 5:
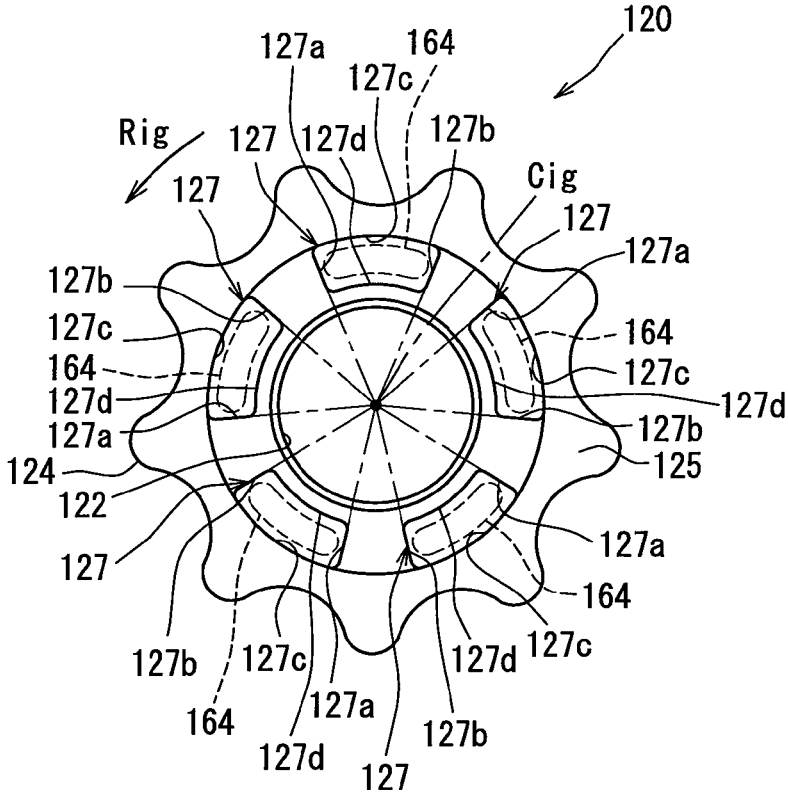
FIG. 5 is a plan view of an inner gear of the first embodiment.

The inner gear 120, which is indicated in FIGS. 1, 4 and 5, is centered at the inner central axis Cig and is thereby coaxial with the rotatable shaft 104*a* (i.e., coaxial with a rotational axis of the rotatable shaft 104*a*), so that the inner gear 120 is eccentrically placed in the receiving space 156. An inner peripheral portion 122 of the inner gear 120 is radially supported by the radial bearing 150, and two slide surfaces 125 of the inner gear 120, which are respectively formed at two opposed axial ends of the inner gear 120, are supported by the recessed bottom portion 116*c* of the pump casing 116 and the pump cover 112, respectively, in a manner that enables rotation of the inner gear 120.

The inner gear 120 has a gear main body 120*a* and a plurality of insertion holes 127. The insertion holes 127 extend in the axial direction at a corresponding area of the inner gear 120 (more specifically, a corresponding area of the gear main body 120*a* of the inner gear 120), which is opposed to the installation space 158. In the present embodiment, the number of the insertion holes 127 is five, and these insertion holes 127 are arranged one after another at equal intervals in the circumferential direction along the rotational direction Rig. The insertion holes 127 extend through the inner gear 120 from the installation space 158 side to the recessed bottom portion 116*c* side in the axial direction. Legs (projections) 164 of the joint member 160 are inserted into the insertion holes 127, respectively, so that the drive force of the rotatable shaft 104*a* is transmitted to the inner gear 120 through the joint member 160. Thereby, the inner gear 120 is rotated in the circumferential direction about the inner central axis Cig in response to the rotation of the rotatable shaft 104*a* of the electric motor 104 while the slide surfaces 125 of the inner gear 120 are slid along the recessed bottom portion 116*c* and the pump cover 112, respectively. The insertion holes 127 serve as through-holes of the present disclosure.

The inner gear 120 includes a plurality of external teeth 124*a*, which are formed in an outer peripheral portion 124 of the inner gear 120 and are arranged one after another at equal intervals in the circumferential direction along the rotational direction Rig. Each of the external teeth 124*a* can axially oppose the suction passage 113, the discharge passage 117, the discharge groove 114 and the suction groove 118 in response to the rotation of the inner gear 120. Thereby, it is possible to limit sticking of the inner gear 120 to the recessed bottom portion 116*c* and the pump cover 112.

As shown in FIGS. 1 and 4, the outer gear 130 is eccentric to the inner central axis Cig of the inner gear 120, so that the outer gear 130 is coaxially received in the receiving space 156. In this way, the inner gear 120 is eccentric to, i.e., is decentered from the outer gear 130 in an eccentric direction De, which is the radial direction. An outer peripheral portion 134 of the outer gear 130 is radially supported by the inner peripheral portion 116*b* of the pump casing 116 in a manner that enables rotation of the outer gear 130. Furthermore, the outer peripheral portion 134 of the outer gear 130 is axially supported by the recessed bottom portion 116*c* of the pump casing 116 and the pump cover 112 in a manner that enables the rotation of the outer gear 130. The outer gear 130 is rotatable in the rotational direction (certain rotational direction) Rog about an outer central axis Cog, which is eccentric to the inner central axis Gig.

The outer gear 130 has a plurality of internal teeth 132*a*. The internal teeth 132*a* are formed in an inner peripheral portion 132 of the outer gear 130 and are arranged one after another at equal intervals in the rotational direction Rog. The number of the internal teeth 132*a* of the outer gear 130 is set to be larger than the number of the external teeth 124*a* of the inner gear 120 by one. Each of the internal teeth 132*a* can axially oppose the suction passage 113, the discharge passage 117, the discharge groove 114 and the suction groove 118 in response to the rotation of the outer gear 130. Thereby, it is possible to limit sticking of the outer gear 130 to the recessed bottom portion 116*c* and the pump cover 112. Hereinafter, with reference to FIGS. 7 and 8A (as well as FIGS. 9 to 21 discussed later), an upward direction along the rotational axis of the inner gear 120 will be also referred to as a first direction, and a downward direction along the rotational axis will be also referred to as a second direction. Furthermore, an upper side along the rotational axis of the inner gear 120 will be also referred to as a first direction side, and a lower side along the rotational axis of the inner gear 120 will be also referred to as a second direction side.

Figure 7:
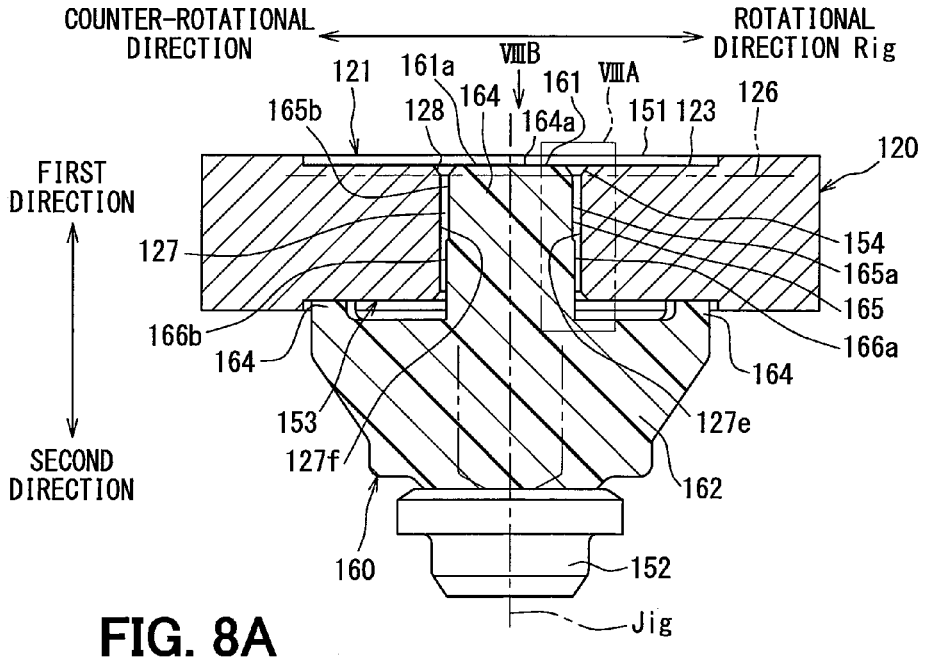
FIG. 7 is an enlarged view of the joint member and the inner gear of the first embodiment.

With reference to FIG. 7, a first balance groove 121 and a second balance groove 153 are formed at two end portions of the inner gear 120 (more specifically two end portions of the gear main body 120*a* of the inner gear 120), which are opposed to each other in the axial direction. The first balance groove 121 is located at the first direction side (the axially upper side) in FIGS. 1 and 7, and the second balance groove 153 is located at the second direction side (the axially lower side) in FIGS. 1 and 7. The first balance groove 121 and the second balance groove 153 are axially recessed from two end surfaces, respectively, of the inner gear 120, which are axially opposed to each other, toward the inner side of the inner gear 120. Each of the first balance groove 121 and the second balance groove 153 is shaped such that each of the first balance groove 121 and the second balance groove 153 circumferentially extends about the rotatable shaft 104*a* and also radially extends in a direction away from the inner central axis Cig, as an annular groove. Furthermore, both of the first balance groove 121 and the second balance groove 153 are directly communicated with and are thereby continuous with the insertion holes 127.

The first balance groove 121 and the second balance groove 153 have a function of stabilizing an orientation of the inner gear 120 by axially urging the inner gear 120 with a fuel pressure in a state where the first balance groove 121 and the second balance groove 153 are filled with fuel during rotation of the inner gear 120. Specifically, the inner gear 120 is balanced in the axial direction by a force, which is exerted in the second direction by the fuel pressure filled in the first balance groove 121, and a force, which is exerted in the first direction by the fuel pressure filled in the second balance groove 153. Here, for the descriptive purpose, an end surface of a portion of the first direction side end portion of the inner gear 120, in which the first balance groove 121 is not formed, is radially inwardly extended to form an imaginary plane (imaginary surface), which is referred to as a first groove end plane 151. The first groove end plane 151 defines a first direction side end of the first balance groove 121. Furthermore, an end surface of the recessed portion of the first balance groove 121 (a bottom surface of the first balance groove 121) is extended to the insertion holes 127 to form an imaginary plane (imaginary surface), which is referred to as a second groove end plane 123. Thus, the numeral 123 also indicates the bottom surface of the first balance groove 121. The first balance groove 121 and the second balance groove 153 serve as recessed grooves of the present disclosure.

Figure 8A:
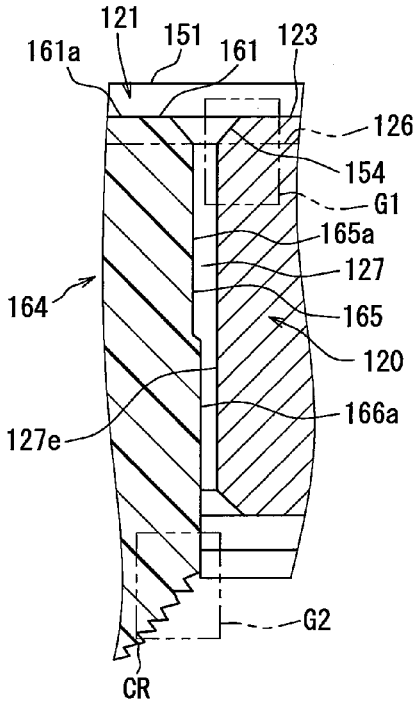
FIG. 8A is a partial enlarged view of an area VIIIA in FIG. 7.

A plurality (two in this embodiment) of chamfered portions is formed in each of peripheral edges of the inner gear 120 (the gear main body 120*a*), each of which is placed adjacent to a corresponding one of the insertion holes 127 (see FIGS. 7 and 8A). In other words, the two chamfered portions are formed in the peripheral edge of each insertion hole 127. In a case where the chamfered portions are not formed in the peripheral edge of the insertion hole 127, which forms a right-angled edge (or an acute-angled edge), when an excessive stress is applied to the peripheral edge of the insertion hole 127 by, for example, the corresponding leg 164, a crack or the like may possibly be generated in the peripheral edge of the insertion hole 127. However, when the chamfered portions are formed in the peripheral edge of the insertion hole 127, it is possible to limit generation of the crack or the like in the chamfered portions of the peripheral edge of the insertion hole 127.

With reference to FIG. 5, the peripheral edge of each insertion hole 127 includes two circumferential end edge sections 127*a*, 127*b*, which are located on the rotational direction Rig side and the counter-rotational direction side, respectively, of the insertion hole 127. The peripheral edge of the insertion hole 127 also includes an outer peripheral edge section 127*c* and an inner peripheral edge section 127*d*, which are located on the radially outer side and the radially inner side, respectively, of the insertion hole 127. In the peripheral edge of the insertion hole 127, one of the chamfered portions is formed by chamfering the circumferential end edge section 127*b*, which is located on the counter-rotational direction side, and this chamfered portion will be hereinafter referred to as a first chamfered portion 128 (see FIG. 7). Furthermore, another one of the chamfered portions is formed by chamfering the circumferential end edge section 127*a*, which is located on the rotational direction Rig side, and this chamfered portion will be hereinafter referred to as a second chamfered portion 154 (see FIG. 7). The outer peripheral edge section 127*c* and the inner peripheral edge section 127*d* are not chamfered (unchamfered). However, if it is desirable, the outer peripheral edge section 127*c* and the inner peripheral edge section 127*d* may be chamfered. Furthermore, in a view taken in a direction that is perpendicular to the axial direction, an imaginary plane, which extends in a direction perpendicular to the axial direction through a second direction side end of the first chamfered portion 128 and a second direction side end of the second chamfered portion 154, will be referred to as a first chamfered end plane 126 (see FIG. 8A). Furthermore, in the view taken in the direction that is perpendicular to the axial direction, an imaginary plane, which extends in the direction perpendicular to the axial direction through a first direction side end of the first chamfered portion 128 and a first direction side end of the second chamfered portion 154, is referred to as the second groove end plane 123 (see FIGS. 7 and 8A), which is also the imaginary plane that extends along the bottom surface of the first balance groove 121, as discussed above. The first chamfered portion 128 and the second chamfered portion 154 serve as chamfered portions of the present disclosure.

The first chamfered portion 128 and the second chamfered portion 154 are symmetric to each other with respect to a leg central axis Jig, which is a central axis of the leg 164.

The inner gear 120 is meshed with the outer gear 130 due to the eccentricity of the inner gear 120 relative to the outer gear 130 in the eccentric direction De. With this configuration, the pump chambers 140 are continuously formed one after another in the rotational direction Rig, Rog between the inner gear 120 and the outer gear 130 in the receiving space 156. A volume of each pump chamber 140 is increased and decreased when the outer gear 130 and the inner gear 120 are rotated.

The volume of each of opposing ones of the pump chambers 140, which are axially opposed to and communicated with the suction passage 113 and the suction groove 118, is increased in response to the rotation of the inner gear 120 and the rotation of the outer gear 130. Thereby, the fuel is drawn from the suction inlet 112*a* into the corresponding pump chambers 140 through the suction passage 113. At this time, since the width (radial extent) of the suction passage 113 progressively increases from the start end part 113*c* to the terminal end part 113*d* in the rotational direction Rig, Rog (also see FIG. 2), the amount of fuel drawn into the pump chamber 140 through the suction passage 113 corresponds to the amount of increase in the volume of the pump chamber 140.

The volume of each of opposing ones of the pump chambers 140, which are axially opposed to and communicated with the discharge passage 117 and the discharge groove 114, is decreased in response to the rotation of the inner gear 120 and the rotation of the outer gear 130. Therefore, simultaneously with the suctioning function discussed above, the fuel is discharged from the corresponding pump chamber 140 into the fuel passage 106 through the discharge passage 117. At this time, since the width (radial extent) of the discharge passage 117 progressively decreases from the start end part 117*c* to the terminal end part 117*d* in the rotational direction Rig, Rog (also see FIG. 3), the amount of fuel discharged from the pump chamber 140 through the discharge passage 117 corresponds to the amount of decrease in the volume of the pump chamber 140.

With reference to FIGS. 1 to 6, the joint member 160 is made of synthetic resin, such as poly phenylene sulfide (PPS). The joint member 160 relays the rotatable shaft 104*a* to the inner gear 120 to rotate the inner gear 120 in the circumferential direction. The joint member 160 includes the main body 162 and the legs 164. The main body 162 serves as a joint main body of the present disclosure.

The main body 162 is installed in the installation space 158, which is formed in the pump cover 112. A fitting hole 162*a* is formed in a center of the main body 162, and thereby the main body 162 is shaped into a circular ring form. When the rotatable shaft 104*a* is fitted into the fitting hole 162*a*, the main body 162 is securely fitted to the rotatable shaft 104*a* to rotate integrally with the rotatable shaft 104*a*.

The number of the legs 164 corresponds to the number of the insertion holes 127 of the inner gear 120. Specifically, in order to reduce or minimize the influence of the torque ripple of the electric motor 104, the number of the legs 164 is different from the number of the magnetic poles and the number of the slots of the electric motor 104 and is thereby set to five (5), which is a prime number, in the present embodiment. The legs 164 axially extend from a plurality of locations (five locations in the present embodiment), respectively, on a radially outer side of the fitting hole 162*a*, which is a fitting location of the main body 162. The legs 164 are arranged one after another at equal intervals in the circumferential direction. Each leg 164 is resiliently deformable because of the resilient material and the axially elongated shape of the leg 164. When the rotatable shaft 104*a* is rotated, each leg 164 is flexed through the resilient deformation thereof in conformity with the corresponding insertion hole 127. Thereby, the leg 164 contacts an inner wall of the insertion hole 127 while absorbing circumferential dimensional errors of the insertion hole 127 and the leg 164 generated at the manufacturing. In this way, the joint member 160 transmits the drive force of the rotatable shaft 104*a* to the inner gear 120 through the legs 164.

Figure 6:
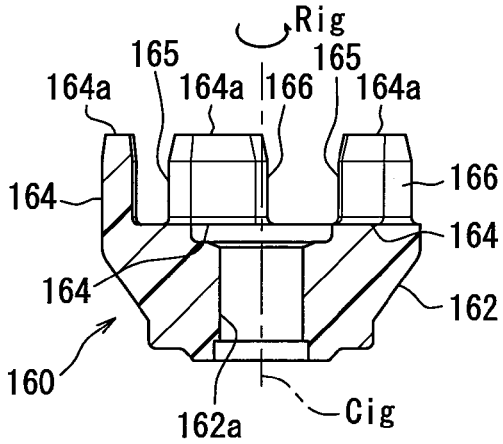
FIG. 6 is a partial cross-sectional view of a joint member of the first embodiment.

Each leg 164 is inserted into the corresponding insertion hole 127 such that a gap is formed between the inner wall of the insertion hole 127 and the leg 164 in a direction perpendicular to the axial direction. As shown particularly in FIG. 1, in the insertion hole 127, which extends through the inner gear 120 in the axial direction, although a distal end 164*a* of each leg 164 extends to an axial location, which is on the electric motor 104 side of a barycentre of the inner gear 120, in the axial direction, the distal end 164*a* of the leg 164 does not extend to the outside of the insertion hole 127. Furthermore, as shown in FIG. 6, the distal end 164*a* of each leg 164 is shaped into a guide form to ease installation of the distal end 164*a* of the leg 164 into the insertion hole 127 at the time of manufacturing.

Figure 8B:
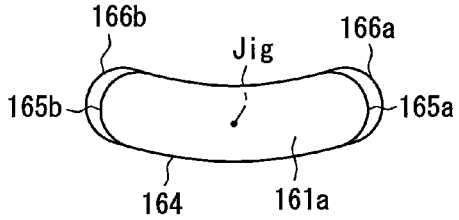
FIG. 8B is a plan view of a leg of the joint member taken in a direction of an arrow VIIIB in FIG. 7.

Each leg 164 has an upper portion 165 at the first direction side of the leg 164. The upper portion 165 has two circumferential end portions 165*a*, 165*b*, which are located at two opposite circumferential ends, respectively, of the upper portion 165. The circumferential end portions 165*a*, 165*b* are circumferentially opposed to two planar portions (two circumferential end portions) 127*e*, 127*f*, respectively, of the inner wall of the insertion hole 127. As shown in FIG. 8B, which is a plan view of the leg 164 taken in a direction of an arrow VIIIB in FIG. 7, each circumferential end portion 165*a*, 165*b* is convexly curved. Particularly in the present embodiment, each circumferential end portion 165*a*, 165*b* is shaped into a semi-cylindrical form having a generatrix (also referred to as a generating line) that extends in the axial direction.

Furthermore, each leg 164 has two circumferential projections 166*a*, 166*b*, which are axially located on the second direction side of the upper portion 165 and circumferentially project from the circumferential end portions 165*a*, 165*b*, respectively, away from the leg central axis Jig (see FIGS. 8A and 8B). The projections 166*a*, 166*b* are formed at or around an axial center portion of the leg 164 such that in the inserted state of the leg 164 where the leg 164 is inserted into the insertion hole 127 during a non-operating period of the electric motor 104, a gap is circumferentially formed between the projection 166*a*, 166*b* and the corresponding adjacent one of the planar portions 127*e*, 127*f* of the inner wall of the insertion hole 127. In the inserted state of the leg 164 where the leg 164 is inserted into the insertion hole 127, the projections 166*a*, 166*b* are circumferentially opposed to the inner gear 120 (more specifically, the planar portions 27*e*, 127*f* of the inner wall of the insertion hole 127).

The projections 166*a*, 166*b* extend to the lower end (the second direction side end) of the leg 164 in the axial direction. The amount of circumferential projection of each of the projections 166*a*, 166*b*, which is measured in the circumferential direction that is perpendicular to the axial direction, is constant along the axial extent of the projection 166*a*, 166*b*.

As shown in FIG. 7, in the inserted state of the leg 164 where the leg 164 is inserted into the insertion hole 127, a first direction side end surface 161*a* (i.e., an end surface of the distal end 164*a*) of a first direction side end portion 161 of the leg 164 is located between the first chamfered end plane 126 and the first groove end plane 151 in the axial direction in the view taken in the direction perpendicular to the axial direction. Specifically, in the present embodiment, the axial location of the first direction side end surface 161*a* of the leg 164 generally coincides with the axial location of the second groove end plane 123. In other words, the distal end 164*a* of the first direction side end portion 161 of the leg 164 does not project beyond the bottom surface (the second groove end plane 123) of the first balance groove 121 in the first direction. That is, the outer peripheral surface of the leg 164 does not substantially have a portion that contacts the fuel, which is filled in the region of the first balance groove 121, in the direction perpendicular to the axial direction.

Next, advantages of the present embodiment will be described.

Figure 19:
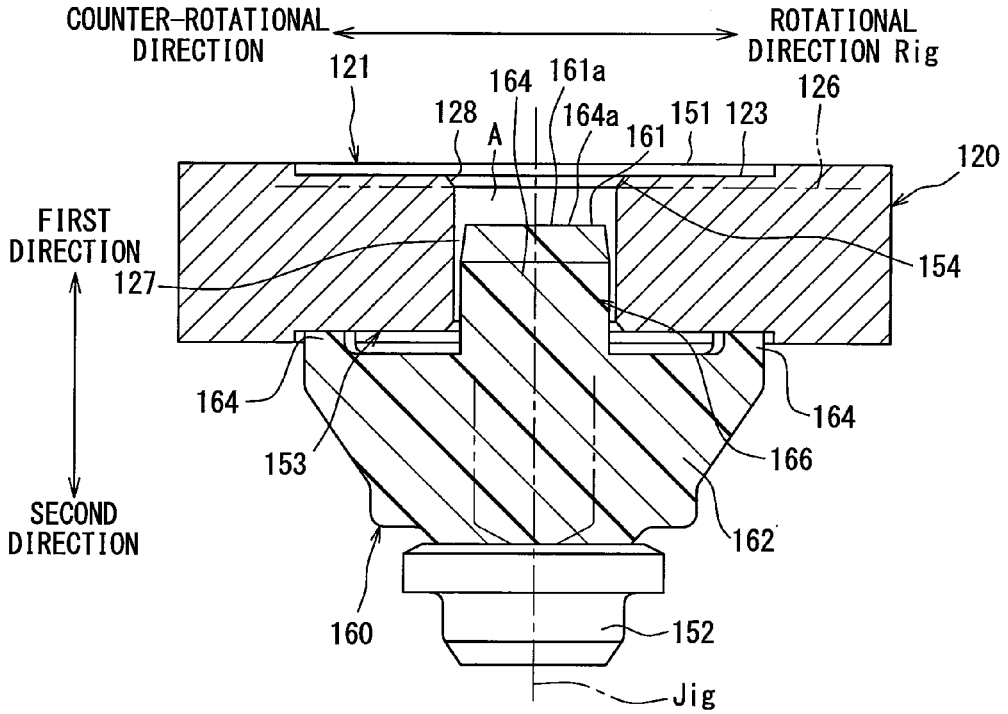
FIG. 19 RELATED ART
FIG. 19 is an enlarged view of a joint member and an inner gear of a fuel pump in a first comparative example.

(1) As shown in FIG. 19, in the case of the first comparative example where the first direction side end surface 161*a* of the leg 164 is placed on the second direction side of the first chamfered end plane 126, the relatively large gap space A is formed between the first direction side end surface 161*a* of the leg 164 and the second groove end plane 123 of the first balance groove 121. The inventors of the present application have found that in the state where the fuel is filled in the gap space A, when the joint member 160 is rotated, the fuel pressure in the gap space A is changed. In such a case, the force, which is exerted to the inner gear 120 in the second direction, and the force, which is exerted to the inner gear 120 in the first direction, are unbalanced. That is, the stable rotation of the inner gear 120 becomes difficult.

Figure 20:
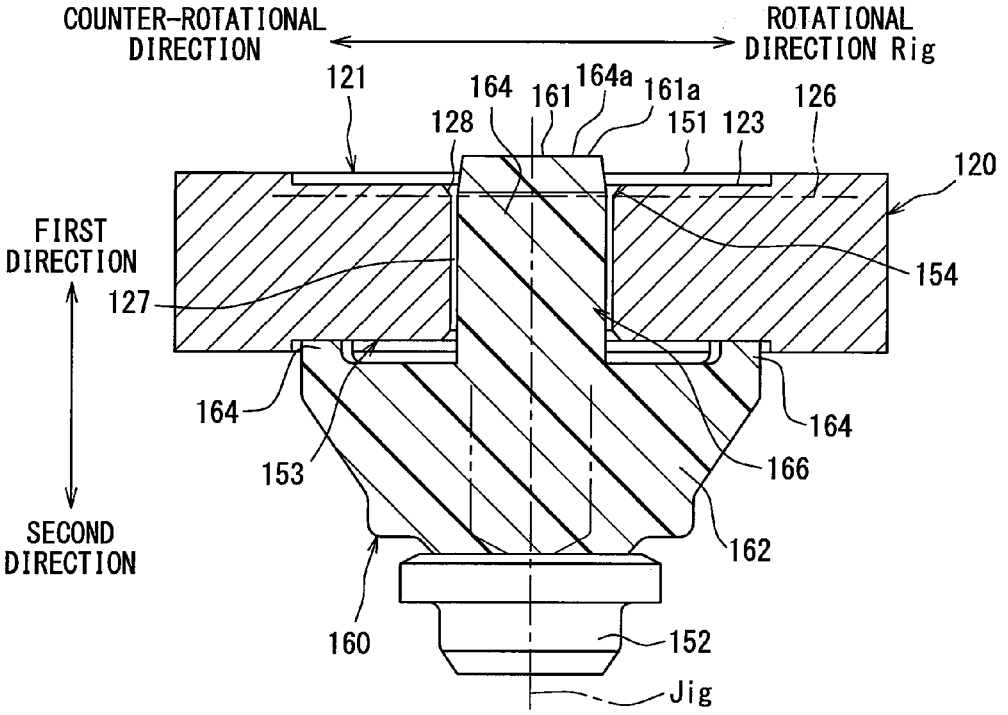
FIG. 20 RELATED ART
FIG. 20 is an enlarged view of a joint member and an inner gear of a fuel pump in a second comparative example.

Furthermore, the inventors of the present application have also found that with reference to FIG. 20, in the case of the second comparative example where the first direction side end surface 161*a* of the leg 164 is placed on the first direction side of the first groove end plane 151 of the first balance groove 121, the leg 164 substantially projects from the insertion hole 127, and thereby the projected portion of the leg 164 may possibly contact with the other member. In such a case, the unnecessary force may be applied to the joint member 160, and thereby the stable transmission of the drive force from the joint member 160 to the inner gear 120 may become difficult to possibly interfere with the stable rotation of the inner gear 120.

In contrast, according to the present embodiment, in the view taken in the direction perpendicular to the axial direction, the first direction side end surface 161*a* of the leg 164 is located between the first chamfered end plane 126 and the first groove end plane 151 in the axial direction. Therefore, it is possible to limit the unstable rotation of the inner gear 120, which may possibly occur in the first comparative example and the second comparative example. Thus, according to the present embodiment, it is possible to provide the fuel pump 101 that enables the stable rotation of the inner gear 120.

Figure 21:
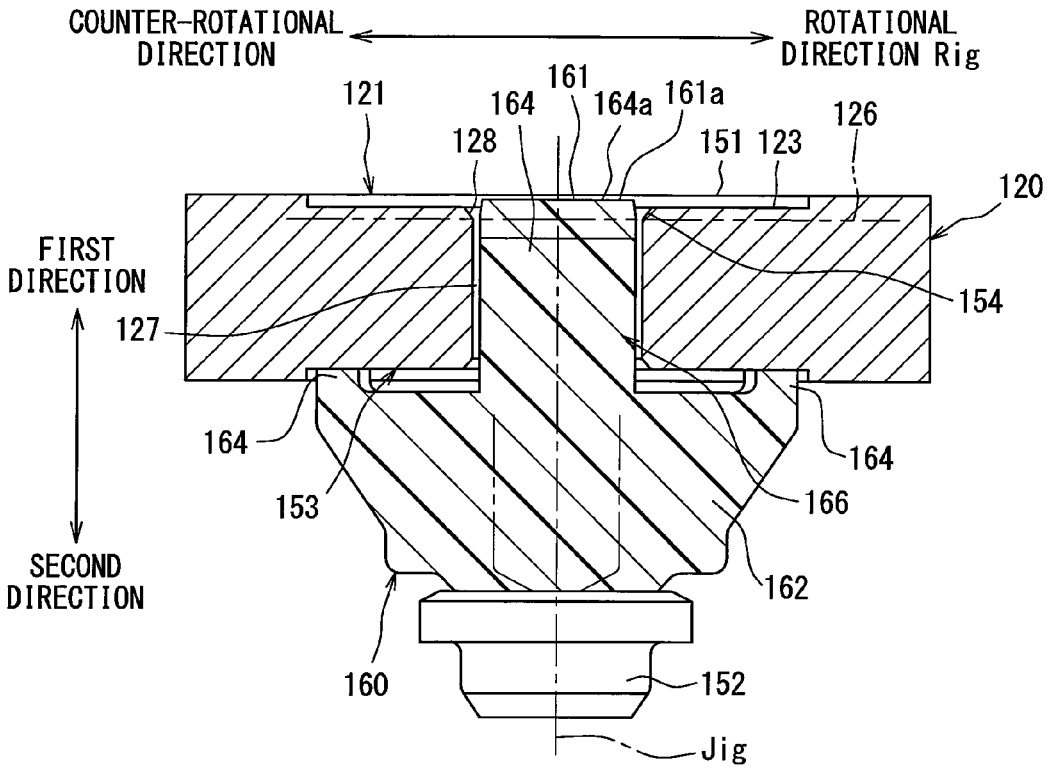
FIG. 21 RELATED ART
FIG. 21 is an enlarged view of a joint member and an inner gear of a fuel pump in a third comparative example.

(2) As shown in FIG. 21, in a case of a third comparative example where the first direction side end surface 161*a* of the leg 164 of the joint member 160 is located between the second groove end plane 123 and the first groove end plane 151 in the view taken in the direction perpendicular to the axial direction, there is a possibility of that the inner gear 120 is not stable in the axial direction. Specifically, in the case of the third comparative example, the portion of the leg 164, which is placed in the first balance groove 121, will contact the fuel, which is filled in the first balance groove 121, in the direction perpendicular to the axial direction. In such a case, when the joint member 160 is rotated, the fuel, which is filled in the first balance groove 121, is agitated to cause a change in the fuel pressure in the first balance groove 121. This will result in that the force, which is exerted to the inner gear 120 in the second direction, and the force, which is exerted to the inner gear 120 in the first direction, are unbalanced. Thus, the stable rotation of the inner gear 120 is interfered.

In contrast, according to the present embodiment, the axial location of the first direction side end surface 161*a* of the leg 164 generally coincides with the axial location of the second groove end plane 123. Therefore, the outer peripheral surface of the leg 164 does not substantially have a portion that contacts the fuel, which is filled in the region of the first balance groove 121, in the direction perpendicular to the axial direction. Thereby, it is possible to limit the contact of the leg 164 of the joint member 160 with the fuel, which is filled in the first balance groove 121, in the direction perpendicular to the axial direction. Thus, the agitation of the fuel filled in the first balance groove 121 can be limited at the time of rotating the joint member 160. Thus, the inner gear 120 can be stably rotated.

Furthermore, since the joint member 160 is made of the resin, the first direction side end surface 161*a* of the leg 164 may possibly project from the first groove end plane 151 in the first direction in the case where the resin of the joint member 160 swells in the axial direction to increase the size of the joint member 160 in the axial direction. However, according to the present embodiment, even at the time of swelling of the resin of the joint member 160, the possibility of projecting the first direction side end surface 161*a* of the leg 164 from the first groove end plane 151 in the first direction can be reduced or minimized, and thereby it is possible to limit the contact of the joint member 160 to the other member.

(3) According to the present embodiment, in the view taken in the direction perpendicular to the axial direction, the first direction side end surface 161*a* of the leg 164 is located between the first chamfered end plane 126 and the first groove end plane 151. With this structure, there is a possibility of collision of the first direction side end portion 161 of the leg 164 against an upper inner peripheral corner portion (a portion indicated with a dot-dot-dash line G1 in FIG. 8A) of the inner gear 120, which is placed adjacent to the insertion hole 127. When this collision occurs, a stress is concentrated at a lower inner peripheral corner portion (a portion indicated with a dot-dot-dash line G2 in FIG. 8A) of the joint member 160, which is furthermost from the upper inner peripheral corner portion (the portion indicated with the dot-dot-dash line G1 in FIG. 8A) to possibly cause generation of a crack CR in the lower inner peripheral corner portion (the portion indicated with the dot-dot-dash G2 line in FIG. 8A). However, in the present embodiment, the projections 166*a*, 166*b* are formed at or around the axial center portion of the leg 164 to circumferentially project away from the leg central axis Jig. Therefore, the collision of the leg 164 of the joint member 160 takes placed at the projection 166*a* against the inner gear 120 (more specifically, the planar portion 127*e*) at the time of rotating the joint member 160 in the rotational direction Rig. Thus, the collision of the first direction side end portion 161 of the leg 164 against the upper corner portion (the portion G1) of the inner gear 120 can be limited. This is also true when the joint member 160 is rotated in the counter-rotational direction. That is, the collision of the leg 164 of the joint member 160 takes placed at the projection 166*b* against the inner gear 120 (more specifically, the planar portion 127*f*) at the time of rotating the joint member 160 in the counter-rotational direction. Therefore, the generation of the crack in the joint member 160 can be advantageously limited.

Second Embodiment

A second embodiment of the present disclosure will be described with reference to FIGS. 9 to 11. In the second embodiment, the description of the portions, which have already described in the first embodiment, will be simplified or omitted.

Figure 9:
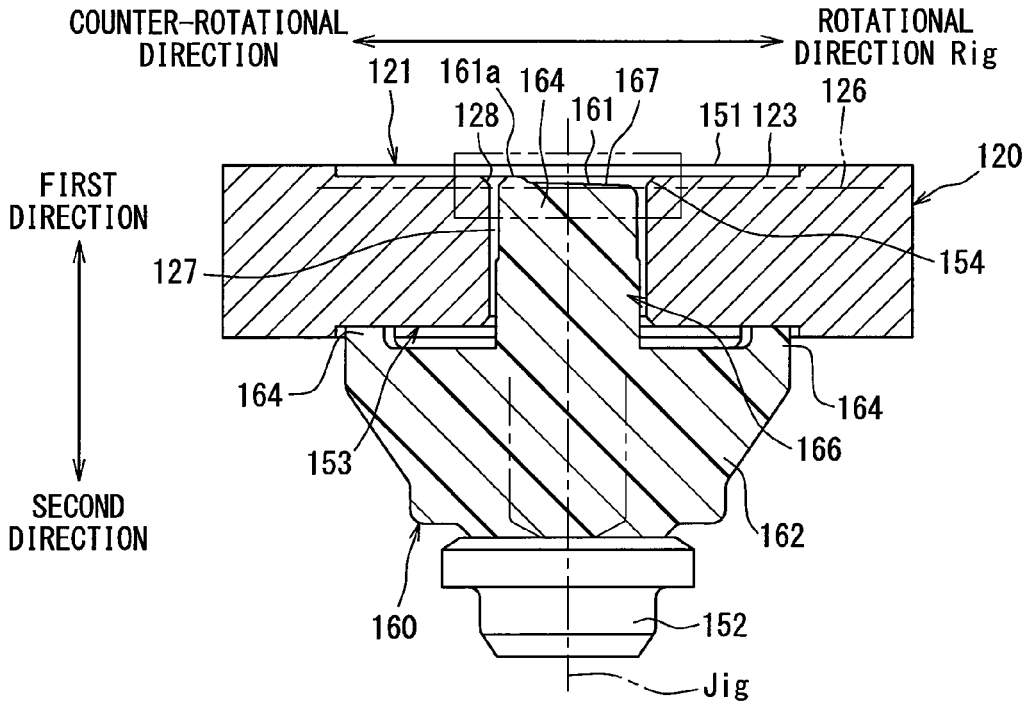
FIG. 9 is an enlarged view of a joint member and an inner gear of a fuel pump according to a second embodiment of the present disclosure.
Figure 10:
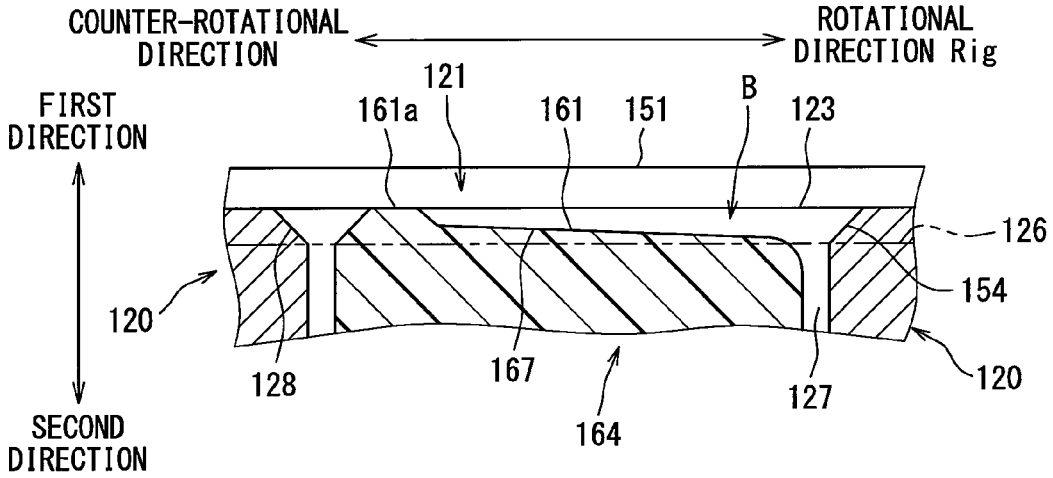
FIG. 10 is an enlarged view of an area indicated with a dot-dot-dash line in FIG. 9.
Figure 11:
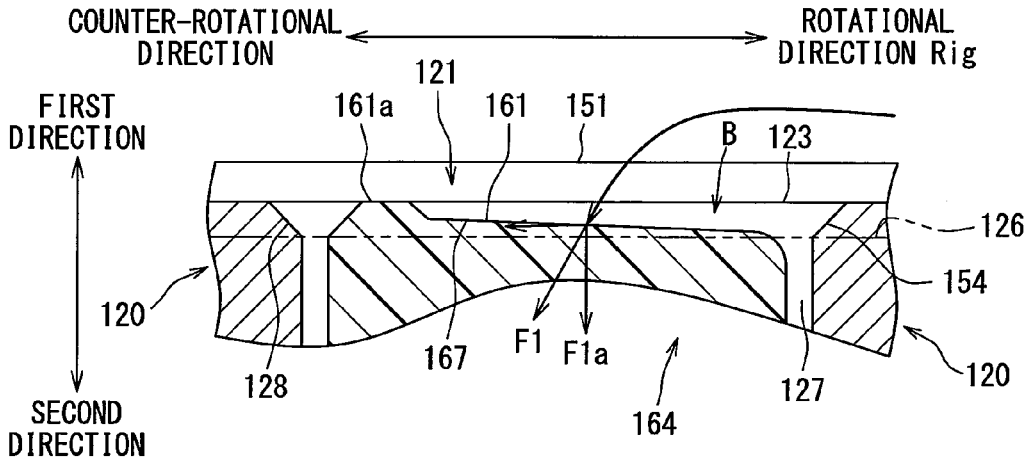
FIG. 11 is a view similar to FIG. 10, showing collision of fuel to a first recessing portion of a leg of the joint member according to the second embodiment.

In the present embodiment, as shown in FIGS. 9 and 10, the first direction side end surface 161*a* of each of the legs 164 includes a first recessing portion 167, which is axially recessed toward the second direction side, and the amount of recess of the first recessing portion 167, which is measured in the axial direction, progressively increases in the rotational direction Rig of the joint member 160. An axial location of a counter-rotational direction side end of the first recessing portion 167 generally coincides with the axial location of the second groove end plane 123 in the view taken in the direction perpendicular to the axial direction. An axial location of a rotational direction Rig side end of the first recessing portion 167 generally coincides with the axial location of the first chamfered end plane 126 in the view taken in the direction perpendicular to the axial direction. As discussed above, at the first direction side, a portion of the first direction side end portion 161 of the leg 164 is recessed on the second direction side of the second groove end plane 123 to form the first recessing portion 167, and thereby a predetermined gap B is axially formed between the first direction side end surface 161*a* (more specifically, a first direction side end surface of the first recessing portion 167) of the leg 164 and the second groove end plane 123.

Next, advantages of the present embodiment will be described.

In an operational stage, which is before increasing of the fuel pressure filled in the first balance groove 121 to a sufficient level (sufficient fuel pressure), i.e., in an initial operational stage where the joint member 160 begins to rotate, it is demanded to urge the joint member 160 toward the second direction side as soon as possible. This is for the purpose of rotating the joint member 160 in a state where the joint member 160 makes surface-to-surface contact with the thrust bearing 152. When the joint member 160 makes the surface-to-surface contact with the thrust bearing 152, tilting of the legs 164 relative to the axial direction can be limited. Thereby, each leg 164 can make surface-to-surface contact with the inner gear 120. Thus, it is possible to limit generation of a crack, which is caused by concentration of a stress through a point-to-point contact of the leg 164 with the inner gear 120.

However, in the case where the first direction side end surface 161*a* of the leg 164 is a flat surface that extends in a direction perpendicular to the axial direction, the fuel pressure is not sufficiently high at the initial operational stage where the joint member 160 begins to rotate, and thereby the axial force, which is exerted from the fuel to the joint member 160, is not sufficiently high.

In view of the above point, according to the present embodiment, the first direction side end surface 161*a* of the leg 164 has the first recessing portion 167, which is axially recessed toward the second direction side, and the amount of recess of the first recessing portion 167, which is measured in the axial direction, progressively increases in the rotational direction Rig of the joint member 160. Thus, as shown in FIG. 11, during the rotation of the joint member 160, a portion of the fuel collides against the first direction side end surface 161*a* (more specifically, the first direction side end surface of the first recessing portion 167) of the leg 164 in a direction that is other than the direction perpendicular to the axial direction. As a result, an urging force F1*a*, which is an axial force component, is generated as a component of a force F1 of the fuel applied to the first direction side end surface 161*a* (more specifically, the first direction side end surface of the first recessing portion 167) of the leg 164. Thereby, the axial urging force F1*a* is exerted to the leg 164 by the force F1, which is the collision force of the fuel generated at the time of colliding the fuel against the first direction side end surface 161*a* (more specifically, the first direction side end surface of the first recessing portion 167). Thus, even in the operational stage, which is before the increasing of the fuel pressure filled in the first balance groove 121 to the sufficient level, the axial force can be exerted against the joint member 160 in the second direction, and thereby the joint member 160 can be quickly urged in the second direction after the start of the rotation of the joint member 160.

Third Embodiment

A third embodiment of the present disclosure will be described with reference to FIGS. 12 to 14. In the present embodiment, the description of the portions, which have already described in the first embodiment and/or the second embodiment, will be simplified or omitted.

Figure 12:
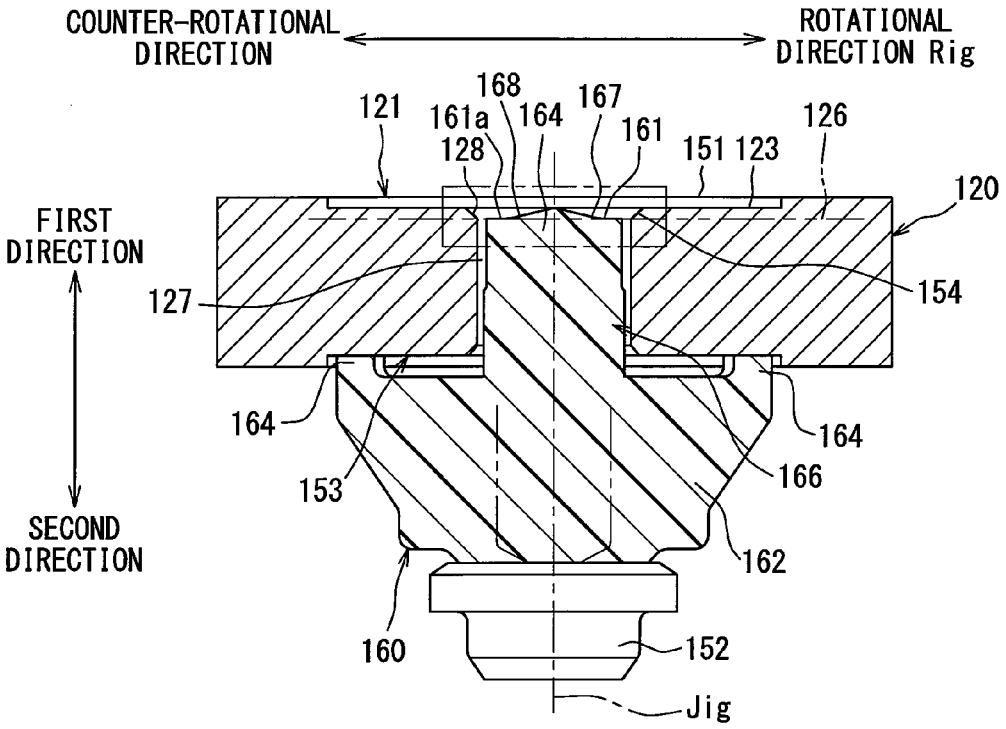
FIG. 12 is an enlarged view of a joint member and an inner gear of a fuel pump according to a third embodiment of the present disclosure.
Figure 13:
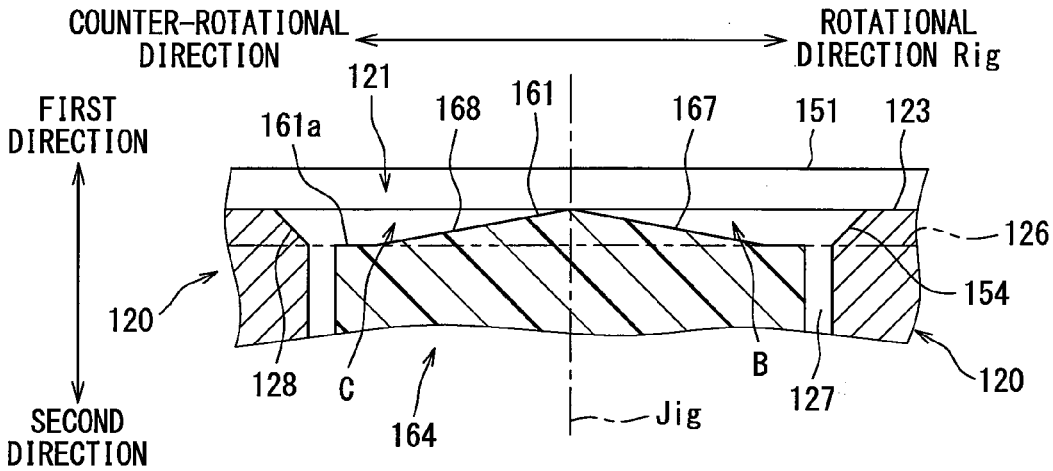
FIG. 13 is an enlarged view of an area indicated with a dot-dot-dash line in FIG. 12.
Figure 14:
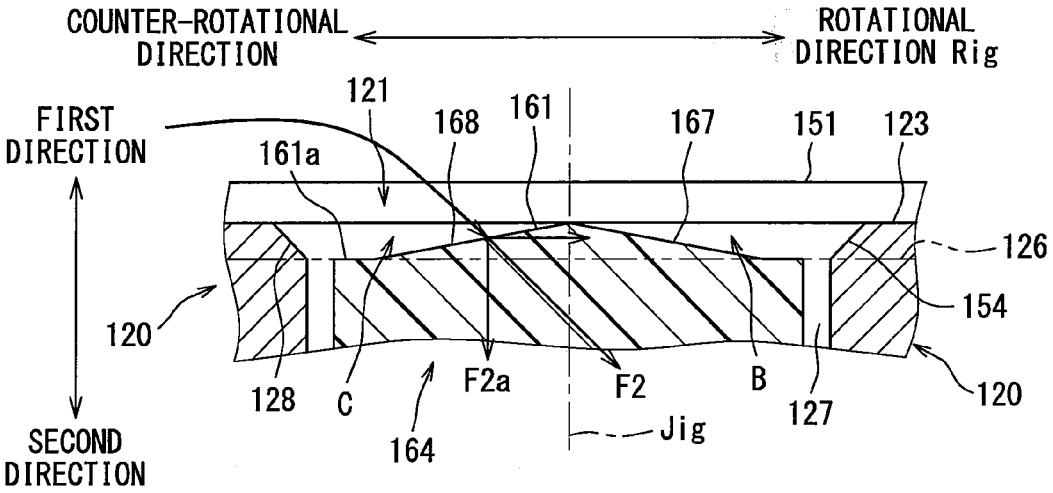
FIG. 14 is a view similar to FIG. 13, showing collision of fuel to a second recessing portion of a leg of the joint member according to the third embodiment.

In the present embodiment, as shown in FIGS. 12 and 13, in addition to the first recessing portion 167 of the second embodiment, the first direction side end surface 161*a* of each leg 164 includes a second recessing portion 168, which is axially recessed toward the second direction side, and the amount of recess of the second recessing portion 168, which is measured in the axial direction, progressively increases in the counter-rotational direction of the joint member 160. The first recessing portion 167 and the second recessing portion 168 are formed to be symmetric to each other with respect to the leg central axis Jig. In a view taken in the direction perpendicular to the axial direction, an axial location of an intersection between the first recessing portion 167 and the second recessing portion 168 generally coincides with the axial location of the second groove end plane 123. In the view taken in the direction perpendicular to the axial direction, an axial location of a counter-rotational direction side end of the second recessing portion 168 generally coincides with the axial location of the first chamfered end plane 126. At the first direction side, the portion of the first direction side end portion 161 of the leg 164 is recessed on the second direction side of the second groove end plane 123, and a predetermined gap C is formed between a first direction side end surface of the second recessing portion 168 of the leg 164 and the second groove end plane 123.

Next, advantages of the present embodiment will be described.

In a case where the electric motor 104 is a brushless motor, at a start preparation time (e.g., a time of turning on of an ignition switch of the vehicle), a positioning control operation of the electric motor 104 is executed to rotate the rotatable shaft 104*a* in the rotational direction Rig or the counter-rotational direction. At this time, the fuel pressure, which is filled in the first balance groove 121, is not sufficiently high, and thereby the urging force, which urges the joint member 160 in the second direction, is not sufficient.

However, with the structure of the present embodiment, when the joint member 160 is rotated in the counter-rotational direction, a portion of the fuel is introduced into the gap C. At that time, as shown in FIG. 14, the fuel collides against the end surface of the second recessing portion 168, so that there is generated an axial force component F2*a* of a force F2 that is exerted by the fuel collided against the end surface of the second recessing portion 168. According to the present embodiment, when the joint member 160 is rotated in the rotational direction Rig, the joint member 160 can be urged in the second direction by the urging force F1*a*, which is the axial force component of the force F1 exerted by the fuel collided against the end surface of the first recessing portion 167. In contrast, when the joint member 160 is rotated in the counter-rotational direction, the joint member 160 can be urged in the second direction through exertion of the axial force component F2*a* of the force F2 exerted by the fuel collided against the end surface of the second recessing portion 168. Thus, even in the operational stage, which is before the increasing of the fuel pressure filled in the first balance groove 121 to the sufficient level, the axial force can be exerted against the joint member 160 in the second direction, and thereby the joint member 160 can be quickly urged in the second direction after the start of the rotation of the joint member 160.

OTHER EMBODIMENTS

The present disclosure is not limited to the above embodiments, and the above embodiments may be modified within the technical scope of the present disclosure. Furthermore, the components of each of the above embodiments may be combined with the components of any other one or more of the above embodiments.

Figure 15:
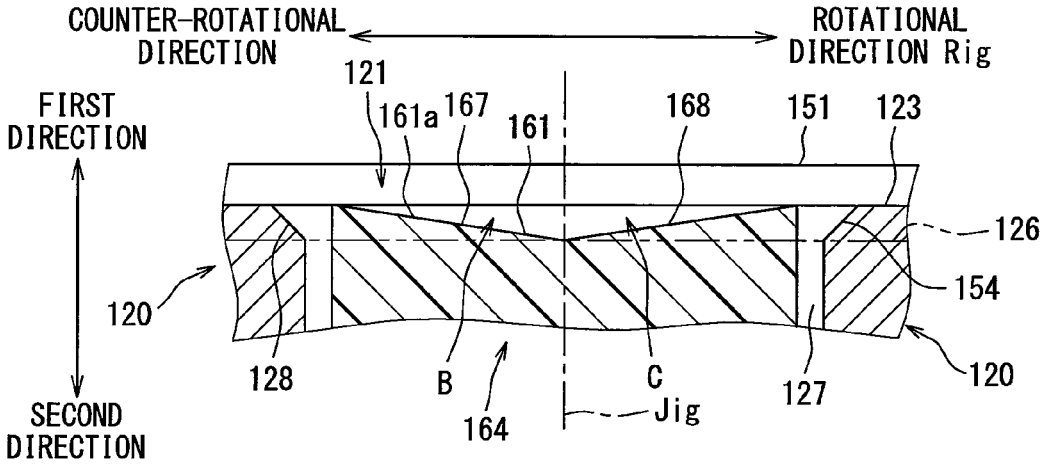
FIG. 15 is a cross sectional view, showing a modification of the joint member of FIG. 13.

The shape of the first direction side end portion 161 of the leg 164 should not be limited to any of the above embodiments and may be modified in various ways. For example, as shown in FIG. 15, the first direction side end surface of the first recessing portion 167 and the first direction side end surface of the second recessing portion 168 may be projected in the first direction such that the amount of projection of the first direction side end surface of the first recessing portion 167 progressively increased from the leg central axis Jig in the counter rotational direction, and the amount of projection of the first direction side end surface of the second recessing portion 168 progressively increases from the leg central axis Jig in the rotational direction Rig. At this time, the axial location of the counter-rotational direction side end of the first recessing portion 167 and the axial location of the rotational direction Rig side end of the second recessing portion 168 may coincide with or may not coincide with the axial location of the second groove end plane 123.

Figure 16:
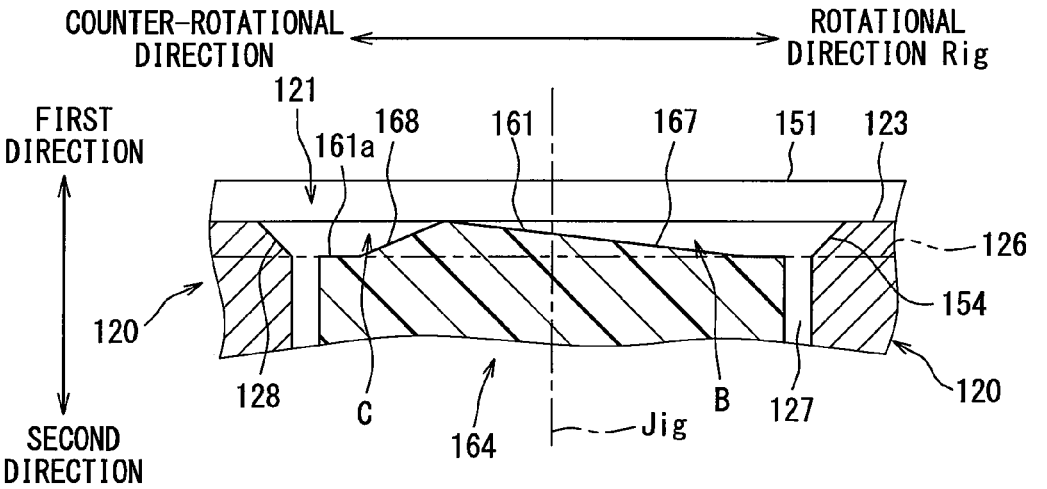
FIG. 16 is a cross sectional view, showing another modification of the joint member of FIG. 13.
Figure 17:
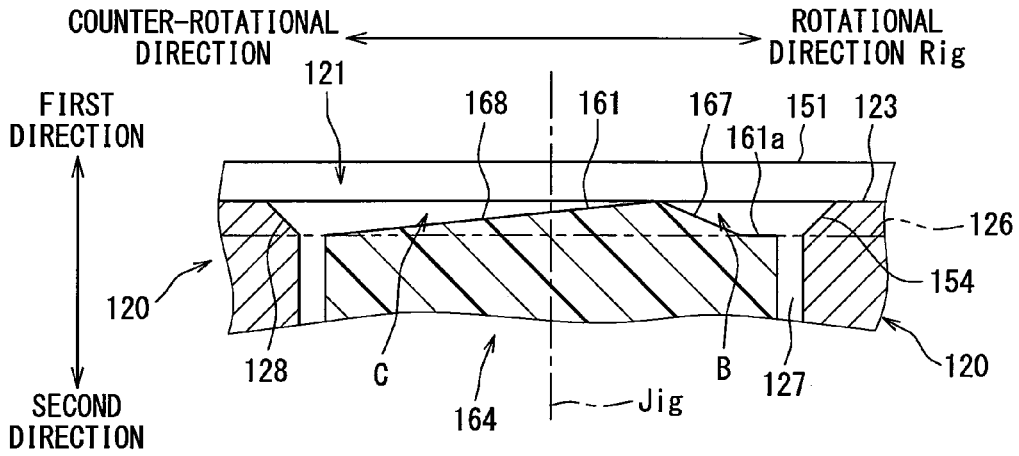
FIG. 17 is a cross sectional view, showing another modification of the joint member of FIG. 13.

Furthermore, as shown in FIGS. 16 and 17, the first recessing portion 167 and the second recessing portion 168 may be asymmetric to each other with respect to the leg central axis Jig. Specifically, the boundary between the first recessing portion 167 and the second recessing portion 168 may be displaced from the leg central axis Jig in the rotational direction Rig or the counter-rotational direction. When a time period of executing the positioning control operation of the electric motor 104, i.e., a time period t1, during which the possibility of colliding the fuel against the first direction side end surface of the second recessing portion 168 exits, is compared with a time period from the time point of starting the rotation of the joint member 160 in the rotational direction Rig after the end of the positioning control operation to the time point of reaching the sufficient fuel pressure, i.e., a time period t2, during which the fuel collides against the first direction side end surface of the first recessing portion 167, the time period t2 is longer than the time period t1. Thus, the structure of FIG. 16, in which the boundary between the first recessing portion 167 and the second recessing portion 168 is displaced from the leg central axis Jig in the counter rotational direction to increase the amount of fuel collided against the first direction side end surface of the first recessing portion 167, allows the exertion of the larger force against the joint member 160 in the second direction within the shorter time period in comparison to the structure of FIG. 17, in which the boundary between the first recessing portion 167 and the second recessing portion 168 is displaced from the leg central axis Jig in the rotational direction Rig, so that the joint member 160 can make the surface-to-surface contact with the thrust bearing 152 within the shorter time period with the structure of FIG. 16.

Figure 18:
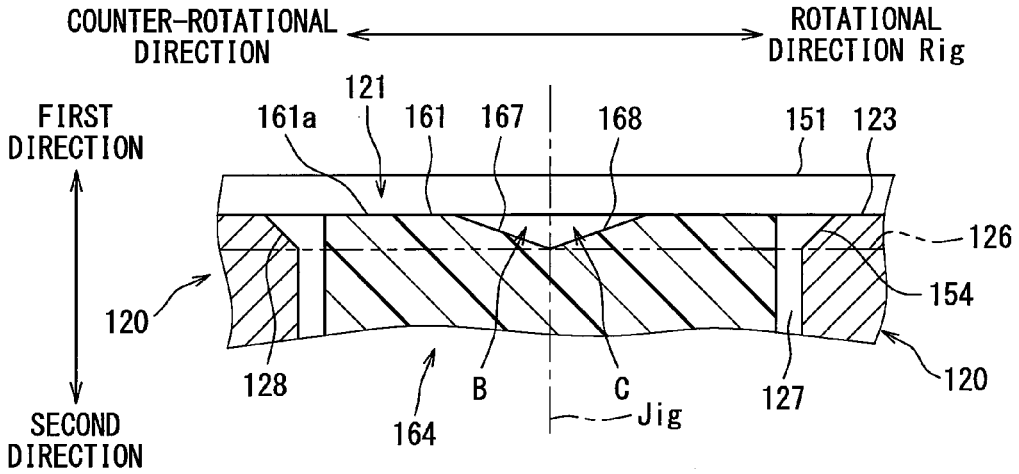
FIG. 18 is a cross sectional view, showing another modification of the joint member of FIG. 13.

As shown in FIG. 18, the first recessing portion 167 may circumferentially extend only to a circumferential intermediate location that is between the leg central axis Jig and the counter rotational direction side end of the leg 164. In other words, the first recessing portion 167 does not need to extend to the counter rotational direction side end (or a location adjacent to the counter rotational direction side end) of the leg 164 in the counter rotational direction. Also, as shown in FIG. 18, the second recessing portion 168 may circumferentially extend only to a circumferential intermediate location that is between the leg central axis Jig and the rotational direction Rig side end of the leg 164. In other words, the second recessing portion 168 does not need to extend to the rotational direction Rig side end (or a location adjacent to the rotational direction Rig side end) of the leg 164 in the rotational direction Rig.

Furthermore, in the view taken in the direction perpendicular to the axial direction, the axial location of the first direction side end portion 161 of the leg 164 can be anywhere between the first chamfered end plane 126 and the first groove end plane 151.

The circumferential projections 166*a*, 166*b* may be axially displaced from the axial center of the leg 164. It is only required that the circumferential projections 166*a*, 166*b* are not axially placed adjacent to the first direction side end portion 161 and the second axial side end portion of the leg 164.

In the above embodiments, the electric motor 104 is used as a drive source for driving the fuel pump 101. Alternatively, the inner gear 120 may be driven to rotate by a portion of a drive force for driving the vehicle, such as a drive force of a crankshaft of an internal combustion engine of the vehicle.

In the above embodiments, the light oil (the diesel fuel) is used as the fuel. Alternatively, the fuel of the present disclosure may be any other type of liquid fuel, such as gasoline or alcohol.

What is claimed is:

1. A fuel pump comprising:

an outer gear that has a plurality of internal teeth;

an inner gear that has a plurality of external teeth, wherein the inner gear is eccentric to the outer gear in an eccentric direction and is meshed with the outer gear in the eccentric direction;

a pump housing that rotatably receives the outer gear and the inner gear;

a motor that includes a rotatable shaft, which is driven to rotate upon energization of the motor; and a joint member that relays the rotatable shaft to the inner gear to rotate the inner gear in circumferential direction about an inner central axis of the inner gear, wherein:

the inner gear includes:

a gear main body;

a through-hole that extends through the gear main body in an axial direction of the rotatable shaft;

two recessed grooves that are formed at two end portions, respectively, of the gear main body, which are opposite to each other in the axial direction, such that the two recessed grooves are recessed in the axial direction and are continuous with the through-hole; and a chamfered portion that is formed in a peripheral edge of the gear main body, which is adjacent to the through-hole;

the joint member includes:

a joint main body that is fitted to the rotatable shaft; and a leg that extends from the joint main body in the axial direction and is inserted into the through-hole;

an inserting direction of the leg into the through-hole in the axial direction is defined as a first direction, and a direction, which is opposite from the first direction in the axial direction, is defined as a second direction;

in a view taken in a direction that is perpendicular to the axial direction, at least a part of a first direction side end portion of the leg is axially placed between:

a second direction side end of the chamfered portion, which is formed at a first direction side; and a first direction side end of a corresponding one of the two recessed grooves, which is formed at the first direction side.

2. The fuel pump according to claim 1, wherein at least the part of the first direction side end portion of the leg is placed on a second direction side of a second direction side end of the corresponding one of the two recessed grooves, which is formed at the first direction side.

3. The fuel pump according to claim 1, wherein the leg includes a projection that is formed in an axial intermediate portion of the leg and projections in the circumferential direction.

4. The fuel pump according to claim 1, wherein the leg includes a first recessing portion that is formed in a first direction side end surface of the leg and is axially recessed toward a second direction side, and an amount of recess of the first recessing portion, which is measured in the axial direction, progressively increases in a rotational direction of the joint member.

5. The fuel pump according to claim 4, wherein the leg includes a second recessing portion that is formed in the first direction side end surface of the leg and is axially recessed toward the second direction side, and an amount of the second recessing portion, which is measured in the axial direction, progressively increases in an opposite direction that is opposite from the rotational direction of the joint member.

6. The fuel pump according to claim 1, wherein a distal end of the first direction side end portion of the leg does not project beyond a bottom surface of the corresponding one of the two recessed grooves, which is formed at the first direction side, in the first direction.

7. The fuel pump according to claim 6, wherein the distal end of the first direction side end portion of the leg is located between the second direction side end of the chamfered portion and the bottom surface of the corresponding one of the two recessed grooves in the axial direction.

* * * * *